US007113843B2

(12) United States Patent
Bahlmann et al.

(10) Patent No.: US 7,113,843 B2
(45) Date of Patent: Sep. 26, 2006

(54) METHOD FOR THE MAINTENANCE OF A TEXTILE MACHINE

(75) Inventors: Bernd Bahlmann, Schrobenhausen (DE); Sebastian Brandl, Böhmfeld (DE); Adalbert Stephan, Beilngries/Paulushofen (DE); Erwald Lenk, Ingolstadt (DE); Martin Zipperer, Denkendorf (DE)

(73) Assignee: Rieter Ingolstadt Spinnermaschbau AG, Ingolstadt (DE)

( * ) Notice: Subject to any disclaimer, the term of this patent is extended or adjusted under 35 U.S.C. 154(b) by 471 days.

(21) Appl. No.: 10/201,612

(22) Filed: Jul. 24, 2002

(65) Prior Publication Data

US 2003/0056486 A1 Mar. 27, 2003

(30) Foreign Application Priority Data

Jul. 28, 2001 (DE) ..... 101 37 056

(51) Int. Cl.
*G06F 19/00* (2006.01)

(52) U.S. Cl. ..... 700/130

(58) Field of Classification Search ..... 57/268, 57/15, 264, 263; 104/173.1; 700/139, 130, 700/143

See application file for complete search history.

(56) References Cited

U.S. PATENT DOCUMENTS

| | | | | |
|---|---|---|---|---|
| 4,192,129 | A | 3/1980 | Stahlecker | |
| 4,418,525 | A | 12/1983 | Raasch | |
| 4,532,759 | A | 8/1985 | Bischofberger | |
| 4,768,443 | A | 9/1988 | Bruggisser et al. | |
| 4,840,022 | A | 6/1989 | Karl et al. | |
| 4,890,450 | A | 1/1990 | Karl et al. | |
| 4,944,033 | A * | 7/1990 | Erni | 700/130 |
| 5,347,449 | A * | 9/1994 | Meyer et al. | 700/80 |
| 5,386,684 | A | 2/1995 | Simon et al. | |
| 5,801,949 | A | 9/1998 | Raasch et al. | |
| 6,014,592 | A | 1/2000 | Fechter et al. | |
| 6,226,971 | B1 | 5/2001 | Stephan | |
| 6,474,461 | B1 | 11/2002 | Grabovszky | |
| 2003/0036816 | A1 | 2/2003 | Zipperer | |
| 2003/0056487 | A1 | 3/2003 | Zipperer | |

FOREIGN PATENT DOCUMENTS

| | | | |
|---|---|---|---|
| DE | 3900229 | A1 | 7/1990 |
| DE | 3909746 | A1 | 10/1990 |
| DE | 3942916 | A1 | 7/1991 |
| DE | 4221504 | C2 | 1/1993 |
| DE | 4212629 | A1 | 10/1993 |
| DE | 4216512 | C2 | 11/1993 |
| DE | 19547068 | | 6/1997 |
| EP | 0433775 | B1 | 12/1990 |

OTHER PUBLICATIONS

German Patent Office Search Report, May 23, 2002.
Patent Abstract of Japan No. 59069367A, Apr. 19, 1984.
Patent Abstract of Japan No. 59069367A.

* cited by examiner

*Primary Examiner*—John J. Calvert
*Assistant Examiner*—Brian Kauffman
(74) *Attorney, Agent, or Firm*—Dority & Manning, P.A.

(57) ABSTRACT

The invention relates to a method for the maintenance of a plurality of processing stations (13) of a textile machine (10), whereby at least one first maintenance unit (14*a–d*) can travel alongside the processing stations (13) in order to service and/or control the processing stations (13). The maintenance unit (14*a–d*) may be moved into an optimized readiness position when none of the processing stations (13) needs to be serviced and/or controlled by the maintenance unit. Alternatively, the direction of travel in which the maintenance unit (14*a–d*) is to travel to the next processing station (13) in need of service is determined, whereby the direction of travel depends on the totality of processing stations in need of maintenance.

31 Claims, 3 Drawing Sheets

METHOD FOR THE MAINTENANCE OF A TEXTILE MACHINE

BACKGROUND

The present invention relates to a method for the maintenance of a plurality of processing stations of a textile machine, whereby at least one first maintenance unit can travel alongside the processing stations in order to service and/or control the processing stations.

In a known open-end spinning machine (DE 199 17 971 A1) a maintenance unit passes a plurality of spinning stations on one side of the open-end spinning machine and services the spinning station as needed. For this purpose, the maintenance unit patrols a row of spinning station along a guide rail. If the maintenance unit then encounters a spinning station that is signaling a defect, the maintenance unit attempts to put the spinning station back into operation. If this succeeds, the maintenance unit continues its travel in the original direction. If however the attempted maintenance fails several times, the affected spinning station is registered as not serviceable and the maintenance unit continues its travel and when it next passes the spinning station registered as non-serviceable that spinning station is no longer serviced by the maintenance unit. The spinning station's inability to be serviced is signaled to an operator so that he may carry out inspection tasks at the spinning station. In addition, a record is made if the maintenance unit is repeatedly unable to on several different spinning stations, it being then concluded that this is due to a malfunction of the maintenance unit. This malfunction is then also signaled and the inspection of the maintenance unit is carried out. By ignoring the spinning stations that cannot be serviced, the work efficiency of the maintenance unit is increased, since it no longer makes additional maintenance attempts at the non-serviceable spinning stations.

SUMMARY

It is therefore an object of the present invention to provide a process for the maintenance of a textile machine with a plurality of processing stations, whereby the efficiency of maintenance by a maintenance unit is further improved. Additional objects and advantages of the invention will be set forth in part in following description, or may be obvious from the description, or may be learned through practice of the invention.

In the following embodiments of the maintenance process, the efficient utilization of the maintenance unit is determined. The maintenance processes concern a. an optimized readiness position, b. a determination of the direction of travel of the maintenance apparatus as a function of the processing stations requiring maintenance and/or expected to require maintenance, and/or c. a priority-regulated maintenance.

The ascertainment of the direction of travel or the determination of the optimal readiness position is achieved by means of a control system. The term "control system" should be understood in this case to be an individual control unit or the interaction of several control units. A control unit is e.g. the control unit of a maintenance unit, whereby each of several maintenance units of the textile machine has its own control system, or the control system of the textile machine itself which is also called the central machine controls. The data for the execution of control can be made available in the control system. For example, data concerning the number of processing stations, positions of the processing stations, position of the maintenance apparatus (es), dimensions of a maintenance unit (required so as to be able to calculate the distance between the maintenance unit and an obstacle or similar object), statistical data of the processing stations such as production efficiency, success probability in carrying out a maintenance task by the maintenance unit, expected time until the end of a production batch, etc. These data are preferably available in the central machine controls of the textile machine. The central machine controls can then control the movements of the individual maintenance units or they transmit them to the appropriate maintenance unit for the evaluation of relevant data, where they are then evaluated for the control of movement. The controls are preferably adapted to the hierarchy of control between textile machine and maintenance unit as provided on the textile machine.

In this case, a maintenance unit may be a robot carrying out one or more operational steps at the processing stations of the textile machine. These could be e.g. the cleaning of the processing station, the restarting of the processing station after a stoppage or presenting source materials, etc. In an open-end spinning machine, a piecing robot will for example carry out a bobbin replacement when a bobbin is filled with spun yarn, or it will carry out piecing at the spinning station in case of a yarn breakage.

The maintenance unit may perform one single maintenance routine at the processing station, or a number of different maintenance tasks. The optimized readiness position or the optimized travel strategy (deciding on direction etc.) can be provided for several maintenance units carrying out the same or different maintenance tasks at different processing stations. An optimization algorithm can in this case be different for each individual maintenance unit, e.g. as a function of the maintenance routine to be carried out.

Optimization of the readiness position or travel strategy is especially effective when the maintenance unit is able to perform different maintenance tasks. This is especially true for a piecing robot of an open-end spinning machine. These maintenance units are of great complexity and thus their acquisition cost increases so that the greatest possible workload for such a complex maintenance unit is wanted. At the same time various marginal conditions must be taken into account when optimizing, because of the different maintenance processes that the maintenance unit is able to perform, so that a sharp increase of work efficiency is possible even when observing many marginal conditions.

For the optimization of the readiness position and/or of the optimized travel strategy (determination of direction of travel) shown below, an optimized travel or maintenance strategy is developed for the maintenance unit as a function of the work required of it. If no maintenance is required at the moment, the maintenance unit moves into an optimized readiness position from which a plurality of processing stations can be reached rapidly. By avoiding patrol travel without actually carrying out maintenance tasks, the undercarriage of a maintenance unit, for example, is saved from wear. Starting from the readiness position or from a processing station where a maintenance task has just been performed, the conventional patrol travel is not resumed, but the maintenance unit travels within range of processing stations where the approach and performance of required maintenance can most rapidly result in a resumption of production at the processing stations. Preventive maintenance of processing stations can be carried out in particular when the overall work load of the maintenance unit is not great and if at the moment a "processing pause" is used for preferred maintenance. The waiting time that would otherwise be necessary is utilized for preferred maintenance so that workload peaks occurring subsequently may be eased. Especially through the combination of the optimized readiness positions and the travel strategies as compared with the classic patrol travel, a considerable increase in efficiency is achieved for a maintenance unit. This increase in efficiency can be used so that each maintenance unit can service a greater number of processing stations.

During the maintenance process for a textile machine, a maintenance unit travels alongside a plurality of processing stations in order to service and/or control them. In order to increase work efficiency of the maintenance units in maintaining the processing stations, the maintenance unit is moved into an optimized readiness position along the processing stations if none of the processing stations requires preferred maintenance or is expected to require it at the moment. This means that the maintenance unit is momentarily "unemployed". The maintenance unit then waits in this readiness position for the next needed maintenance task, as soon as one of the processing stations requires maintenance or can be serviced preventively in a preferred maintenance.

In the previously used patrol travel of the maintenance unit, the latter travels alongside all processing stations up to the furthest processing station where the return points for the patrol travel are located. In this process, it is possible that when the maintenance unit reaches a return point, maintenance may be required at a processing station located at the exact opposite end. In this case, the entire travel distance has to be covered, so that the processing station to be serviced is not producing during that time. By parking the maintenance unit in the optimized readiness position, the average travel time to the processing stations is statistically shortened, so that the maintenance unit reaches the processing station more quickly and so that the latter is able to produce sooner following maintenance.

By assuming a readiness position in the physical center among the processing stations to be serviced, it is possible to easily find the readiness position. In this position, the travel distance and thereby the travel time to the outermost processing stations is equal.

If a weighting factor is also taken into account in determining the optimized readiness position and if a weighted central position is derived from this, a number of marginal conditions can be taken into account in determining the readiness position, further reducing the travel time to a processing station on the basis of statistical average. In this case, it is possible to take into account e.g. an uneven distribution of the processing stations, or a maintenance frequency, so that e.g. the maintenance unit is positioned in a region of processing stations requiring more frequent maintenance than another region of operating stations. If the work status detection in the control unit, or sensors detect that a work phase is about to be completed at a processing station, the remaining running time until the actual completion can also be taken into account as a weighting factor. In this case, the magnitude of the weighting factor increases as the remaining running time becomes shorter. An end of the work phase occurs e.g. when the source material runs out or when the acceptance capacity of the receiving device for the product comes to an end.

It may be especially advantageous, in determining the readiness position, to take into account the fact that certain processing stations should not be serviced. This is the case, for example, when the processing station is not in operation, has been marked as non-serviceable, or if an operator has determined e.g. that a particular processing station should not be serviced by the maintenance unit.

The area of processing stations to be serviced by the maintenance unit can advantageously be modified so as to be flexible. The optimized readiness position is then determined for each current work area. Such a work area limitation can be imposed e.g. when obstacles are present in this area for the maintenance unit, or if a second maintenance unit services part of processing stations originally assigned to the first maintenance unit.

In a particular maintenance process, the direction in which the maintenance unit continues or begins its travel is determined as a function of all the processing stations requiring servicing. The travel in the direction thus determined may e.g. take place during an already started travel (e.g. patrolling) or from the position of the maintenance unit, e.g. following maintenance of a processing station. Due to the determination based on the totality of processing stations requiring maintenance, the maintenance unit is moved not to the nearest processing station requiring service or to the nearest processing station in the original direction of travel, but the maintenance unit is moved to the location where the greatest overall need for maintenance exists, and where the greatest number of maintenance units can be put back into operation within a given time span. For example, with the distance to the next processing station requiring service being the same, the processing station that will be approached in either direction will be the one in whose proximity other processing stations requiring servicing are located.

When the direction of travel has been determined, all those processing stations in the direction of travel requiring servicing are advantageously serviced one after the other. The direction of travel can be determined continuously at set time intervals or preferably when the maintenance unit has already been stopped e.g. by the servicing of a processing station.

In such case, only those processing stations are preferably taken into consideration, which are assigned to the operating range of the maintenance unit. This operating range is however advantageously changeable, and the direction of travel can again be optimized in each case for the changed operating range. As described earlier, processing stations not able to be serviced are preferably not taken into account here too when making this determination.

In determining the direction of travel, weighting factors for every processing station are most advantageously also taken into account, so that one or several marginal conditions contribute to a further increase in efficiency for the maintenance of the processing stations. For example, statistical data on maintenance already performed at a processing station is taken into account, such as for instance the success probability of the maintenance unit in putting the processing station back into operation. If, for instance, a processing station is producing again thanks to the maintenance unit following the first maintenance attempt, while another processing station resumes production only after three attempts, then it is more advantageous, from the point of view of production efficiency, to first put the more easily serviced processing station back in operation, as it will then produce until the less successfully pieced processing stations are put into operation.

It is also more efficient to put first those production stations into operation whose production efficiency is the greatest, for example a processing station having low stoppage probability or being able to produce at a greater speed. So that production stations with otherwise unfavorable weighting factors should not be neglected entirely during maintenance, a time-dependent value dependent on the stoppage time of the processing station is advantageously provided. The longer the processing station is stopped, the greater is its weighting value.

In addition, the fact that the processing station is not included in the maintenance by the maintenance unit because the processing station is prevented permanently or from time to time from being put back into operation by the maintenance unit is taken into account. The reason may lie with the processing station and/or with the maintenance unit. If for example no source yam is present in the piecing robot of an open-end spinning machine, the piecing robot cannot piece all those spinning stations where a bobbin replacement has been effected or must be effected. In that case a group of processing stations requiring the same type of maintenance is affected. However, individual single processing stations can also be affected.

In an especially advantageous manner, the fact is also taken into account that although a processing station could be serviced by the maintenance unit, it nevertheless cannot be put into operation due to an additional influence factor not involving the processing station or the maintenance unit. In an open-end spinning machine for example, this is the case when no empty bobbin is available in a bobbin-loading device for the winding up of a spun yam. In a rewinding machine for example, this is the case when the unwinding cop is empty and no new unwinding cop is available, or when a source material is not yet ready for the textile machine so that the processing station can also not be put in operation by the maintenance unit. Such influence factors are detected e.g. via the central machine controls of the textile machine, or the pertinent data is available, so that these can also be taken into account in the determination of the direction of travel.

In another maintenance process embodiment, the maintenance unit is already carrying out a maintenance task on a processing station, although no need for maintenance exists currently. In this case, the processing station on which preventive maintenance is to be performed is still producing, but the production is interrupted by the maintenance unit or by another device, and a preferred maintenance is performed. Such an interruption of production is preferably effected only when the quality of the product is not substantially affected by the interruption. This is the case e.g. in a rotor spinning machine when a yam piecing joint of high quality can be produced. The preferred maintenance performed is a maintenance expected to be necessary within a predetermined period of time, so that it is not necessary to service that processing station when that point in time has been reached. Such preferred maintenance is preferably performed when the maintenance unit is momentarily not needed for service at a processing station requiring maintenance, or when the workload of the maintenance unit caused by actually service-requiring processing stations is relatively low. In that case, the maintenance device can for example service processing stations on which preventive maintenance is to be performed on its way to a processing station actually requiring maintenance, so that empty travel of the maintenance unit from one end of its operating range to the other end is avoided.

In order to determine a processing station's need for maintenance, weighting factors can be taken into consideration here too, such as e.g. greater weighting with decreasing remaining running time until actually necessary maintenance. Preferably the time during which the source material will still be available, or whether the end product has already reached a minimum quantity is thereby taken into account. Thus for example, the remaining quantity of fiber sliver is taken into account in an open-end spinning machine, and when a certain minimum remaining quantity is no longer available, the requirement for preventive maintenance is already signaled. Thereby the leftover remaining fiber sliver can be rejected, and piecing can take place with a new fiber sliver, with the rejected fiber sliver being reconditioned again so that the overall costs of the output product are negligible in view of the gain in production.

It is especially advantageous here to take several processing stations requiring maintenance into account and to determine the direction of travel of the next processing station to be approached and on which preventive maintenance is to be performed in the same way as the determination of the direction of travel to processing stations actually requiring maintenance (see above).

In determining the direction of travel, a mixed mode can be used in which the processing stations actually requiring maintenance as well as the processing stations on which preventive maintenance is to be performed are taken into account as a function of the workload of the maintenance unit. Preferably the weighting in deciding the direction of travel can be further optimized thereby, so that it differs from a decision of the direction of travel taking only into account the processing stations actually requiring maintenance or only taking into account the processing stations on which preventive maintenance is to be performed. For example, the weighting of the processing stations on which preventive maintenance is to be performed is reduced in this case compared to the processing stations actually requiring maintenance.

In another embodiment of the maintenance process, maintenance to be carried out is differentiated according to its priority, whereby at least two priority levels are taken into account. Here those processing stations are serviced first which have a higher-priority need for service. Such a need for service exists for example when the non-performance of this service creates the danger that one or several processing stations may be damaged, or that one or several processing stations will probably also fail soon because of the non-performed maintenance task. In a rotor-spinning machine for example, every processing station must be blow-cleaned by the maintenance unit, whereby fiber fly and impurities that could block components of the rotor-spinning machine or of the spinning station are removed. Such a high-priority maintenance need can exist also with maintenance at regular intervals. Optionally, a sensor can detect the occurrence of such a maintenance need.

After processing the maintenance cases with high priority maintenance need, the next maintenance cases processed are those with a lower maintenance need. Preferably the direction of travel is then determined as described above, in order to achieve the highest possible maintenance efficiency for the low-priority, actual maintenance cases.

As needed, the preferred maintenance cases are also included while the low-priority cases are handled advantageously, e.g. after processing the low-priority maintenance cases. Here too the direction of travel is determined as described above.

After processing the actual maintenance cases and/or the preventive maintenance cases, the maintenance unit is moved into an optimized readiness position. The readiness position is ascertained preferably as described above.

In traveling in the direction of the higher-priority maintenance cases, the maintenance unit also performs maintenance tasks of lower priority in an advantageous embodiment, so that no empty travel occurs in order to perform the higher-priority maintenance. Thus for example, the blow-cleaning of the processing stations must be carried out in a rotor-spinning machine over the entire operating range of the maintenance unit. For this, the outermost processing stations must be reached. In order to increase efficiency, the processing stations on which preventive maintenance is to be performed and the processing stations requiring maintenance are serviced in the course of the travel to the outermost processing stations.

Embodiments of the invention are explained in further detail with the help of drawings.

DETAILED DESCRIPTION

Reference will now be made in detail to embodiments of the invention, one or more examples of which are illustrated in the figures. It should be appreciated that the examples are provided by way of explanation of the invention, and not as a limitation of the invention.

Figure 1:
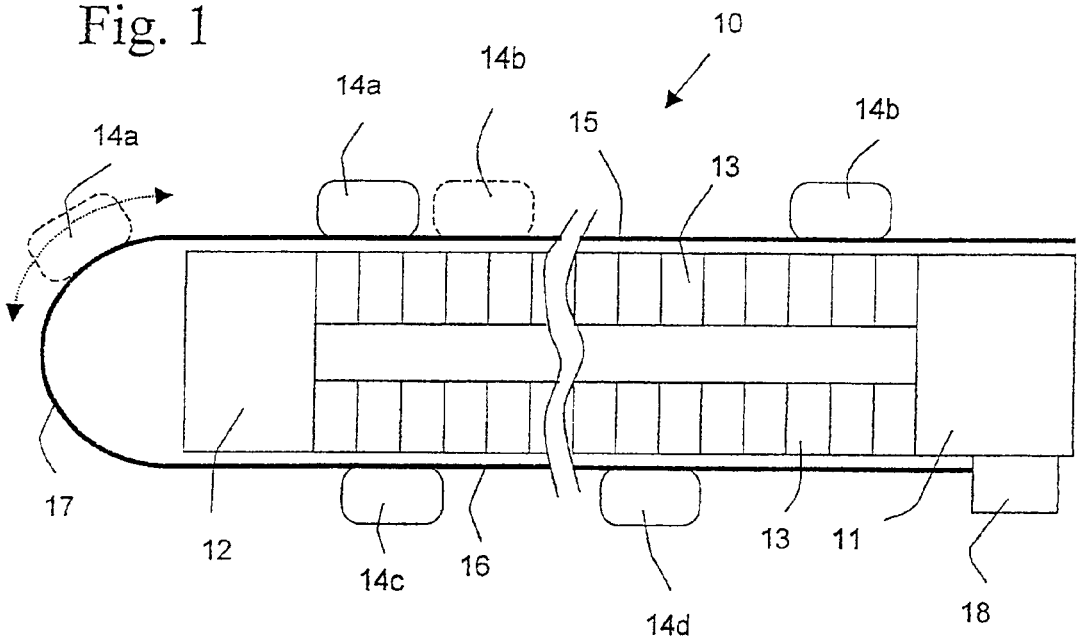
FIG. 1 is a schematic top view of a rotor-spinning machine with two piecing robots per spinning machine side.

FIG. 1 is a schematic top view of a rotor-spinning machine 10 with two piecing robots 14*a–d* per spinning machine side. A plurality of spinning stations 13 are installed next to each other on both sides of the rotor spinning machine 10 between an end frame 11 and a drive frame 12 of the rotor spinning machine 10. An empty-bobbin supply unit 18 is installed adjoining the end frame 11 to supply the end frame with empty bobbins for distribution along the spinning stations 13. The drive aggregates of the common drive of the spinning stations 13 are seated in the drive frame 12 in a known manner. Actually a much greater number of spinning stations 13 than are shown are installed between the frames 11 and 12, and this is indicated by the broken lines.

The piecing robots 14*a–d* described in further detail in the following embodiments are used to piece the yarn, to replace bobbins, to clean the spinning stations 13 etc., as is generally known.

Parallel to the spinning stations 13, on both sides of the rotor-spinning machine 10, runs a guide rail 15, 16. On the guide rail 15, 16 the piecing robots 14*a–d* are mounted on an undercarriage in a known manner so as to be able to be moved about. The two guide rails 15, 16 are connected to each other around the drive frame 12 by a round curve 17 so that the piecing robots 14*a* or 14*c* can be moved at the round curve 17 to the other side. The piecing robots 14 are supplied in a known manner by means of drag chains (not shown) extending parallel to the spinning stations 14. The supply lines for the piecing robots 14, such as electric supply, compressed-air supply, control line and negative pressure line for suction etc., are installed in the drag chains.

Figure 2:
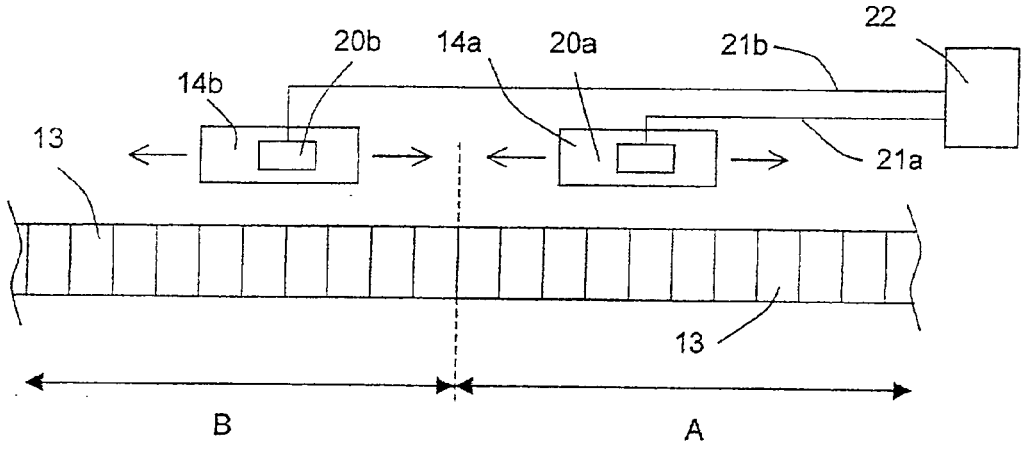
FIG. 2 is a schematic partial top view of two piecing robots servicing two adjoining operating ranges of spinning stations, FIG. 3 schematically shows the approach sequence of the piecing robot traveling to the spinning stations requiring maintenance, FIG. 4 schematically shows the manner in which the spinning stations with different maintenance priorities are approached, FIG. 5 schematically shows the optimized readiness position of a piecing robot within the operating range of spinning stations

FIG. 2 is a schematic top view of the piecing robots 14*a*, 14*b*. In each of the piecing robots 14*a*, 14*b*, a control unit 20*a*, 20*b* is installed and these control units are connected via a communications link 21*a*, 21*b* to central machine controls, or to spinning machine controls 22 of the rotor spinning machine 10. The communications link 21*a*, 21*b* is e.g. a data conduit carried together with the supply lines in the drag chain.

The piecing robot 14*a* services an operating range A of spinning stations 13, whereby the operating range on the right is only shown in part. The piecing robot 14*b* services an operating B of spinning stations 13, whereby the operating range is not shown completely on the left side. The current position of the piecing robots 14*a*, 14*b* is continuously detected and/or calculated. This is achieved either through an initialization of the position of the piecing robot in its basic position, where a position counter is set at a fixed position along the guide rail 15, 16, and where the position is calculated based on the travel distance covered, or by installing position markers along the guide rail 15, 16 so that a detection device (not shown) in the concerned piecing robot 14*a–d* can detect the current position. The determination of the position can also be effected through a combination of initialization, determination of traveled distance and position equalization at the position markers. In the present enibodiment the position of each piecing robot 14*a–d* is continuously recorded centrally in the spinning machine controls 22. In addition the following data, given as examples, are detected in the spinning machine controls 22 via the spinning stations:

$P_k$ Production status of the spinning station k

Where $P_k$=0 when the spinning station is not assigned to the operating range (A or B) of the spinning robot (14*a* or 14*b*) to be optimized here; And $P_k$=1 when it belongs to the operating range. Here and further on, k represents the current number of the spinning station on the open-end spinning machine 10. This number is assigned only once for each of the spinning stations 13, so that each spinning station is clearly identifiable. The operating range A of the piecing robot 14*a* runs here e.g. from the spinning station with number k=1 to the one with number k=150, and the operating range B of the piecing robot 14*b* runs from number k=151 to k=300, if 300 spinning stations are installed per spinning machine side.

$A_k$(service) is the status of the piecing robot

Where $A_k$(service)=0 when a special service need is signaled by the spinning station, but if this service need cannot be satisfied for reasons imputable to the piecing robot. For example, piecing after bobbin replacement is not possible if the robot no longer has any source yarn. Otherwise $A_k$(service)=1 applies. Or else, $A_k$(service)=0 if the textile machine overall is about to reach the end of a production run of the produced end product. In the open-end spinning machine successive service-requiring spinning stations can then be taken out of operation, while the still producing spinning stations deliver the remaining amounts of the product up to the desired batch amount. In this way the necessity of discarding only partially filled cross-wound bobbins is avoided.

$S_k$=Spinning station status

Where Sk=0 if the spinning station has been stopped or is considered stopped; =0.5 if the maintenance is performed by two piecing robots 14;=1 if the spinning station is ready to operate. Stoppage occurs e.g. as known from DE 199 17 971 when the spinning station is no longer taken into consideration for maintenance after three to five unsuccessful piecing attempts. A spinning station can also be taken out of operation via the spinning station status $S_k$=0 if a maintenance cannot be performed at this spinning station because of lacking work coordination with the piecing robot, when for example a bobbin replacement can not be effected because the conveyor belt going to the removal system for full bobbins is full, and when the full bobbin cannot be removed by the piecing robot from the spinning stations to be deposited on the bobbin conveyor belt. Instead of the spinning status $S_k$ an additional, different weighting factor can also be used in such an event.

$E_k$=Distance to the spinning station k.

Normally $E_k$=1/ [k–i] applies when the distance between the spinning stations k is always the same. It can however also be taken into consideration when a piecing robot (e.g. 14*a* or 14*c*) must travel around the round curve 17 in order to reach the corresponding spinning station k. In that case the distances $E_k$ can be stored e.g. in a table.

$R_k$ is the reliability of piecing at the spinning station k by the piecing robot or a value as a function of the duration of the maintenance task.

Here $R_k$=3 when reliability is great; =2 when reliability is low; and =1 when a long waiting period precedes the moment when the spinning station k resumes operation.

$T_k$ weighting factor for the time to a maintenance task about to be necessary at the spinning station k.

Here several different maintenance intervals about to become due or already due can be taken into consideration by means of an OR link for the weighting factor. The blow cleaning of the spinning rotor plate at regular intervals, for example, in order to prevent creeping dirt accumulation is an example of such a maintenance. Here $T_k$=1 for example, when the minimum waiting time before carrying out a routine maintenance task has not yet been reached; and =2 when the maintenance interval has not yet been reached; and =3 when the limit time for the maintenance interval has been exceeded.

$O_k$ is a weighting factor for the stoppage time of the spinning station, without maintenance Where $O_k$=1 when e.g. the spinning station k is waiting up to five minutes for the next maintenance; =2 when the spinning station k is waiting for more than five minutes for maintenance; and =3 when the spinning station is waiting for over 15 minutes for maintenance.

$Q_k$ the Production efficiency of a spinning station k.

Where $Q_k$ =0.5 for spinning station with low efficiency; =1 for spinning station with average efficiency; and =2 for spinning station with high productivity.

The above-listed factors, which are acquired and updated by the spinning machine control unit 22, serve as described below as weighting factors for the control of travel movement of the spinning robots 14. The listed weighting factors and the number values of the weighting factors must be understood to be only examples. Depending on requirements, type of piecing robot, type of textile machine, volume of maintenance tasks of the piecing robots etc., additional weighting factors and different number values can be chosen.

Figure 3:
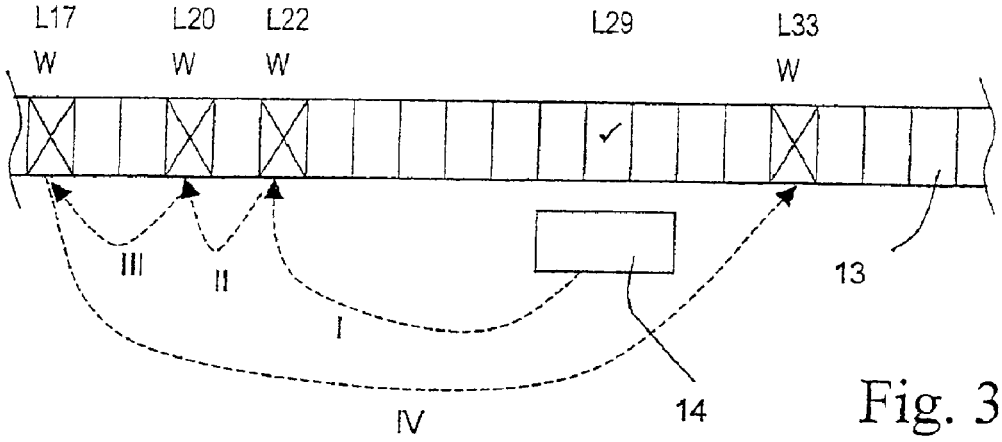

FIG. 3 shows the position of the piecing robot 14 after maintenance has been performed on spinning station L29. Lk is here the running counting index of the number of the spinning station k. Upon completion of the maintenance tasks on the spinning station L29, the piecing robot would continue its maintenance patrol in the original direction of travel in accordance with the classical control process, and would perform maintenance, e.g. in the direction of spinning station L33. This spinning station L33 is the next spinning station requiring maintenance, as symbolized by the cross and the letter "W" in FIG. 3. Here the spinning stations L17, L20 and L22 requiring maintenance would at first not be approached. If the travel were to be continued solely in consideration of the nearest spinning station requiring maintenance, the spinning station L33 would also be approached. After performing maintenance on the spinning station L33, the entire distance from L33 to L22 would have to be covered before the cluster-like grouped spinning stations L17, L20 and L22 could be attended to. For the sake of production efficiency it is however better to put the accumulated spinning stations requiring maintenance in operation, i.e. in this case the momentarily not producing spinning stations L22, L20 and L17 with short distances in between, so that they produce again until the long distance between L22 and L33 is covered. A decision function is therefore included in the travel strategy of the piecing robot, determining the direction of travel to the next spinning station requiring maintenance. For this purpose the weighting function $W_R$ and $W_L$ are set up for both directions of travel, left and right, presenting a weighted function of the work requirement for the left or right direction of travel.

$$W_R = \sum_{k=i+1}^{n} P_k \times A_k \times S_k \times E_k \times R_k \times T_k \times O_k \times Q_k$$

$$W_L = \sum_{k=1}^{i-1} P_k \times A_k \times S_k \times E_k \times R_k \times T_k \times O_k \times Q_k$$

Here i designates the spinning station of the current position of the piecing robot which can be made available in the spinning machine unit as described earlier. In FIG. 3, i=29.

The direction of travel to the right is chosen when $W_R \geqq W_L$. In that case the weighting factor for the right side is greater than or equal to the weighting factor for the left side. If this condition is not met, the travel is continued to the left side. If $W_R$ as well as $W_L$ are equal to 0, no current need for service exists at the moment and the piecing robot 14 can remain in its position of the moment. This saves the undercarriage, i.e. the wear of the undercarriage of the piecing robot is reduced. In addition the required energy can be saved. In case that $W_R$=$W_L$=0, it is also possible to let the piecing robot continue its patrol in the usual manner and blow-clean the spinning stations, for example, so that no fiber fly accumulates there. As soon as one or several spinning stations require maintenance once more, the direction of travel from the current position of the piecing robot is again determined through the above-mentioned formula and the need for maintenance is satisfied in sequence, following this decision strategy. In another embodiment the piecing robot 14 moves into an optimized readiness position (see below).

The determination of the direction of travel by means of the product sum $W_L$, $W_R$ ($D_L$, $D_R$ see below) is only given as an example and can follow some other calculation method.

In calculating the above sums $W_R$ and $W_L$, one or several weighting factors can be taken out and/or other weighting factors can be considered in addition. In the sums of $W_R$ and $W_L$ indicated above, only weighting factors for the actual, already existing maintenance requirements of a spinning station k are taken into consideration, with the exception of the value Tk=2. In addition to the weighting factors in the sums for the already existing maintenance requirements, weighting factors for the need for preferred maintenance can also be taken into consideration. Such a preferred maintenance requirement can be performed for example when the length of the yam wound up on a cross-wound bobbin need not reach a precise value. In that case the length of the yam on the bobbin may be somewhere between a minimum and a maximum length, so that a time interval occurs between the minimum length to the maximum length, and this time interval can be used, depending on the free capacity of the maintenance unit, to effect the bobbin replacement and piecing of the spinning station. Maintenance can also be carried out, for example, if only a residual amount of fiber sliver remains at the feed point of a spinning station and when the fiber sliver can be replaced, also in case of free capacity of the maintenance unit. Also, components of a spinning station subjected to a maintenance cycle by the maintenance unit can be included into a preferred maintenance even though the maintenance cycle has not yet ended currently. This preferred maintenance requirement by various factors can e.g. be linked by an OR function and can thus be united into a single weighting factor $\Delta t_k$.

$\Delta t_k$ is a weighting factor for a preferred maintenance.

Here $\Delta t_k$=1 if the lower limit time for maintenance has not yet been reached; =2 if the lower limit time has been passed; and =3 when the end of the maintenance cycle is imminent, e.g. if only three minutes of time remain. The direction of travel is determined as in the determination of the direction of travel for spinning stations requiring maintenance.

Figure 4:
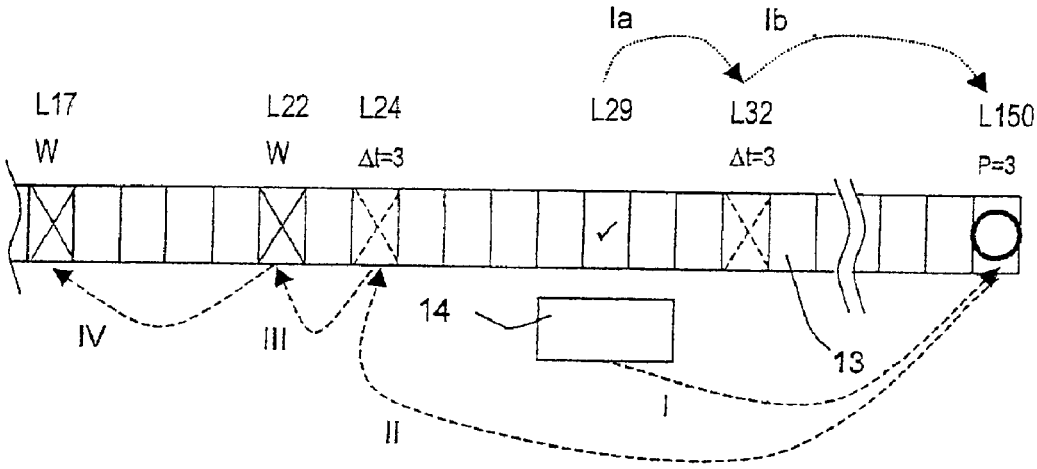

FIG. 4 schematically shows the travel control of the piecing robot 14 in the presence of a need for maintenance from different priority levels. Spinning stations L17 and L22 have already existing, normal need for maintenance, designated by W. Spinning stations L24 and L32 have a need for preferred maintenance, designated by Δt. The spinning station L150 has a maintenance need with high maintenance priority, and this is designated by P=3. During the maintenance routine, the spinning machine controls 22 first check whether a maintenance need with high priority P=3 exists at individual spinning stations. These are then serviced with higher priority than the spinning stations with normal need for maintenance (L17, L22, L24 and L32). For example, the spinning station L150 has not been blow-cleaned for some time, e.g. 20 minutes, by the piecing robot 14. Under normal circumstances the piecing robot 14 constantly blow-cleans the spinning stations during the process, so that no additional need for maintenance occurs. However, if the outermost spinning stations had not been approached for some time, the piecing robot must go to them with high priority in order to ensure smooth functioning even of the outermost spinning stations L1, L150. For this high-priority maintenance task P=3, it is sufficient if only the outermost spinning stations L1, L150 of the operating range A are monitored, since all spinning stations L2–L149 located between them are blow-cleaned automatically when the outermost spinning stations are approached. However, a high-priority maintenance need P=3 can also exist for each individual spinning station k, e.g. the regular cleaning of the spinning rotor after approximately two hours.

Since the maintenance tasks with higher priority are performed first, the piecing robot travels according to FIG. 4 from its momentary position L29 along the travel path I to the spinning station L150 and blow-cleans it. Thereupon the direction of travel is determined as described in FIG. 3. Following this, the travel movement II up to spinning L24 is executed and the piecing robot 14 performs a preferred maintenance at that location. Here for instance, the cleaning of the rotor is expected imminently, so that it is carried out to relieve the robot because it is on its way, even before servicing the spinning station L22 in need of maintenance. From L24 the piecing robot 14 switches over to spinning station L22 by executing the travel movement III and then, with travel movement IV, it goes to the next spinning station L17 in need of maintenance. In other embodiments the spinning robot 14, instead of executing travel movement I to the spinning station L150, can service the spinning stations requiring maintenance or the spinning stations with preferred maintenance need on its way to the spinning station 150. After travel movement Ia for example, the spinning station L32 with preferred maintenance requirement Δt was serviced, and travel movement Ib was then executed.

Figure 5:
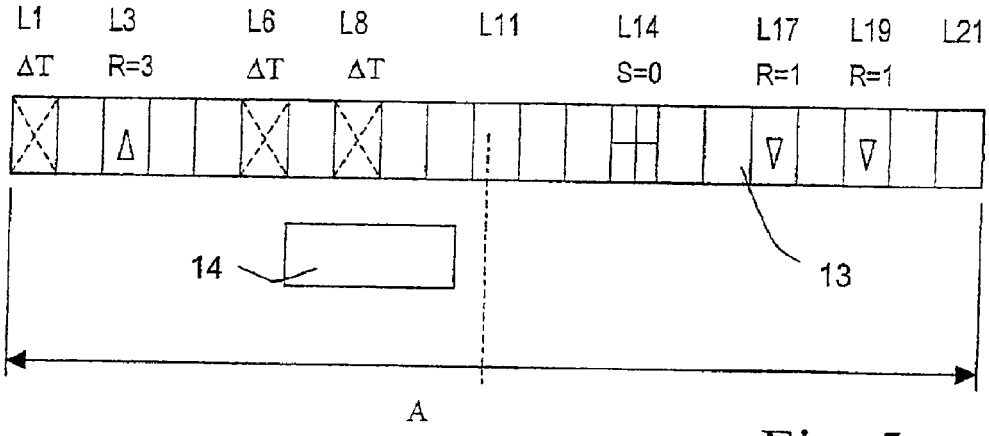

FIG. 5 illustrates an optimal readiness position of the piecing robot 14 when there is no need for maintenance. This optimized readiness position bases itself on the fact that the distance to the next spinning station to be serviced is on statistical average as short as possible. Thereby the travel time to the spinning station is reduced and thus the time until the latter can resume production.

Analogous to the determination of the direction of travel for the maintenance of spinning stations in need of maintenance, two sums are obtained here.

$$D_L = \sum_{k=i+1}^{n} P_k \times E_k \times R_k \times \Delta T_k$$

$$D_R = \sum_{k=1}^{i-1} P_k \times E_k \times R_k \times \Delta T_k$$

Here the weighting factors that were already ascertained earlier to determine the direction of travel are used in part. In addition, the new factor $\Delta T_k$ is taken into consideration.

$\Delta T_k$ is the time until the expectedly necessary maintenance.

By means of an OR link, several maintenance conditions can be linked together in this case. An expected maintenance takes place in that case e.g. when a predetermined yam length has been reached on a cross-wound bobbin, or when a maximum operating time of the spinning rotor before it must again be cleaned at intervals by the maintenance unit has elapsed, or when the fiber sliver is expected to be used up so that a new fiber sliver must be applied, or when the time until expected presentation of an empty bobbin has expired, so that maintenance postponed for lack of the bobbin can finally be performed. It is possible to also take into account additional marginal conditions here, based on which an expected need for maintenance can be calculated in advance. Instead of the OR link in the weighting factor $\Delta T_k$, these can also be included as individual weighting factors in the formation of the product sum. Examples for numerical values of $\Delta T_k$ are: $\Delta T_k$=1, when no need for maintenance exists; =2 when a need for maintenance is expected to arise within five minutes; and =2 when a need for maintenance is expected to arise within two minutes.

The optimized readiness position is determined by the sum products $D_L$, $D_R$ in that these are calculated for all i's and in that then the i where the product sums $D_L$, $D_R$ for the left and for the right side are the same is selected as the optimized readiness position. Another possibility consists in adding up all the k's (i.e. from k-1 to n), in dividing that sum in half and in making a new addition, breaking it off at the i at which precisely one half of the total product sum is reached. The determination of the optimized readiness position i is given here only as an example and can also be determined according to other calculation methods.

In the example shown in FIG. 5, maintenance will imminently be required at the spinning stations L1, L6 and L8; Δ T>1. The spinning station L3 possesses great reliability for piecing, so that it is pieced in preference to the other spinning stations; R=3. The spinning stations L17 and L19 on the other hand, require a long weighting time, e.g. when piecing requires several piecing attempts; R=1. The piecing station L14, with S=0, is marked as being unable to be pieced or serviced, so that it cannot be serviced by the maintenance unit. In FIG. 5 the operating range A of the piecing robot 14 covers 21 spinning stations. The optimized maintenance position deviates from the central spinning station L11, since spinning stations for which maintenance will soon be necessary and/or are highly reliable for piecing are grouped in the left area. On the other hand, to the right of the L11 are spinning stations with low piecing efficiency and those that have been eliminated from maintenance. The weighting shifts therefore the optimal readiness position from the central position L11 to the left.

Figure 6:
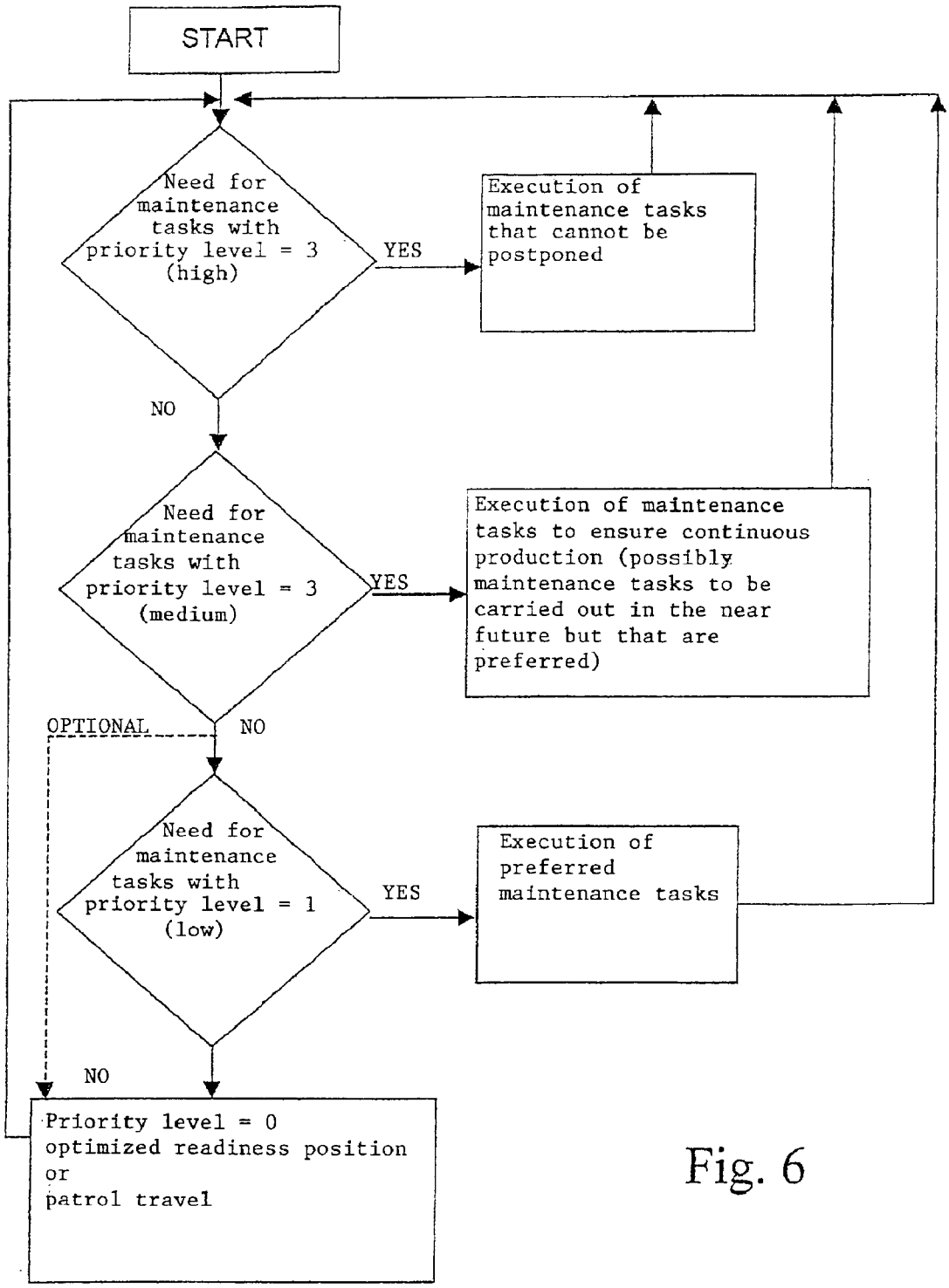
FIG. 6 is a flowchart for the processing of maintenance requirements with different priorities.

FIG. 6 shows an overview of the overall drive strategy for a piecing robot 14 where the need for service with different priorities is processed on several hierarchical levels. Following the start of the control routine a verification is first made to see whether one of the spinning stations 13 or the spinning machine 10 has a need for maintenance that can be carried out by the piecing robot 14 and has very high priority (P=3). If this is so (yes), these not to be postponed maintenance tasks are performed and, following the performance of this task, a new check for high-priority maintenance tasks is made. If there is no maintenance task with high priority level, verification is made to see if maintenance tasks with medium priority level (P=2) are to be performed. If this is so (yes) they are performed in order to ensure continuous production. If several maintenance tasks with medium priority are to be performed, the direction of travel is preferably determined as explained for FIG. 3 above for the travel of the piecing robot. When every single spinning station has been serviced and put into operation, the checking routine is preferably resumed by checking the highest priority level (P-3). It is however also possible to complete at first a certain number of maintenance tasks with medium priority level (P=2), before starting checking with the highest priority.

If neither maintenance with high priority nor with medium priority is to be performed, a check is made whether maintenance tasks with low priority level (P=1) are to be performed. If yes, preferred maintenance tasks are performed at the spinning stations. If several spinning stations require preferred maintenance, the direction of travel for the maintenance is preferably again determined with a weighted product sum. Upon performance of the preferred maintenance or upon servicing all or a certain number of spinning stations with preferred maintenance need, the priority check is started again with the highest priority level (P=3). If no need for maintenance is signaled upon checking the priority levels high to low (P=3, 2, 1), the piecing robot is moved into the optimized readiness position as shown in FIG. 5. Alternatively, the piecing robot can also resume a conventional patrol travel, whereby it patrols up and down along the spinning stations of its operational range.

In the process described above, the maintenance tasks with high priority (P=3) can also be processed through a correspondingly high weighting in the medium priority level (P=2), In another embodiment the low priority level (P=1) can also be omitted entirely, e.g. when the preferred maintenance tasks do not result in an increase in production or if no preferred maintenance is needed.

Instead of the adding up with weighting factors described above, a trained neuronal network or a fuzzy logic can also be used to determine the direction of travel or to find the optimized readiness position. The neuronal network is first trained with model cases where the "ideal" decision is indicated as for a plurality of predetermined parameters of several maintenance constellation, such as contained in the central machine controls for example, as described earlier. By training the neuronal network, the latter finds on its own the weighting factors for all mixes of the predetermined model cases, so that a developer need not take into account all possible constellation in detail, with a targeted selection of predetermined weighting factors. The predetermined parameters of the maintenance constellation can be e.g. the above-mentioned status messages of the spinning stations, status messages of the piecing robots, status messages of the spinning machine, of their efficiency, probability of piecing, missing external added work preventing piecing, missing source yam of the piecing robot, change in the operating range, etc.

It should be appreciated by those skilled in the art that various modifications and variations can be made to the embodiments of the invention described above without departing from the scope and spirit of the invention. It is intended that the present invention include such modifications and variations as come within the scope of the appended claims and their equivalents.

What is claimed is:

1. A method for the maintenance of a plurality of processing stations of a textile machine wherein a maintenance unit travels alongside the processing stations for performing maintenance functions at individual respective processing stations, said method comprising:

defining at least one weighting factor for all of the processing stations, the weighting factor relating to a condition at the processing stations indicative of the need for subsequent maintenance; and determining an optimized readiness position for the maintenance unit alongside the textile machine when none of the processing stations requires the maintenance unit, the readiness position determined as a function of a statistical average of the weighting factor wherein, based on the statistical average, travel time and distance of the maintenance unit from the optimized readiness position to spinning stations requiring subsequent maintenance is reduced.

2. The method as in claim 1, wherein the optimized readiness position is a weighted central position among the processing stations serviced by the maintenance unit, the weighted central position being different from an actual central position among the processing stations.

3. The method as in claim 1, wherein the weighting factor is a function of maintenance frequency of the processing stations.

4. The method as in claim 1, wherein the weighting factor is a function of distance between processing stations that will need to be serviced by the maintenance unit.

5. The method as in claim 1, further comprising identifying any processing stations that cannot be serviced by the maintenance unit and removing the identified processing stations from consideration in the optimization determination.

6. The method as in claim 1, further comprising modifying an operating range of the maintenance unit as a function of an obstacle in the travel path of the maintenance unit, and taking the modified operating range into consideration in the optimization determination.

7. The method as in claim 1, wherein the weighting factor is a function of remaining running time of the processing stations before a maintenance is needed at the processing stations.

8. The method as in claim 7, wherein the remaining running time is the time remaining until a device disposed for receipt of a product produced at the processing stations is full or until a source of material being processed at the processing stations is exhausted.

9. The method as in claim 7, wherein the remaining running time is the time remaining until a component at the processing stations is scheduled to be serviced or replaced.

10. A method for the maintenance of a plurality of processing stations of a textile machine wherein a maintenance unit travels alongside the processing stations for performing maintenance functions at individual respective processing stations, said method comprising:

defining at least one weighting factor used for each of the processing stations, the weighting factor relating to a condition at the processing stations indicative of the need for maintenance; and determining a direction of travel of the maintenance unit to the next processing station to be serviced by the maintenance unit as a function of at least one weighting factor assigned to the processing stations requiring service by the maintenance unit, the weighting factor relating to a condition at the processing stations affecting efficiency of servicing all of the processing stations requiring maintenance.

11. The method as in claim 10, further comprising defining an operating range of the maintenance unit and only considering the weighting factor for processing stations within the operating range.

12. The method as in claim 10, wherein the weighting factor is a function of time elapsed since a missed scheduled maintenance service to be performed by the maintenance unit at the processing stations.

13. The method as in claim 10, further comprising considering processing stations where preventative maintenance can be performed by the maintenance unit as a factor in determining the direction of travel of the maintenance unit.

14. A method for the maintenance of a plurality of processing stations of a textile machine wherein a maintenance unit travels alongside the processing stations for performing maintenance functions at individual respective processing stations, said method comprising:

defining at least one weighting factor for all of the processing stations, the weighting factor relating to a condition at the processing stations indicative of the need for maintenance;

determining a direction of travel of the maintenance unit to the next processing station to be serviced by the maintenance unit as a function of at least one weighting factor assigned to all processing stations requiring service by the maintenance unit, the weighting factor relating to a condition at the processing stations affecting efficiency of servicing all of the processing stations requiring maintenance;

defining an operating range of the maintenance unit and only considering the weighting factor for processing stations within the operating range; and modifying the operating range of the maintenance unit as a function of an obstacle in the travel path of the maintenance unit, and taking the modified operating range into consideration in the optimization determination.

15. A method for the maintenance of a plurality of processing stations of a textile machine wherein a maintenance unit travels alongside the processing stations for performing maintenance functions at individual respective processing stations, said method comprising:

defining at least one weighting factor for all of the processing stations, the weighting factor relating to a condition at the processing stations indicative of the need for maintenance;

determining a direction of travel of the maintenance unit to the next processing station to be serviced by the maintenance unit as a function of at least one weighting factor assigned to all processing stations requiring service by the maintenance unit, the weighting factor relating to a condition at the processing stations affecting efficiency of servicing all of the processing stations requiring maintenance;

defining an operating range of the maintenance unit and only considering the weighting factor for processing stations within the operating range; and considering the number of processing stations to be serviced in each possible direction of travel of the maintenance unit as a factor in determining the direction of travel.

16. The method as in claim 15, wherein the direction of travel of the maintenance unit is determined as a function of a value of the totality of the weighting factors for the processing stations in each possible direction of travel, the possible direction of travel having the greater value of weighting factors being selected as the determined direction of travel.

17. The method as in claim 16, wherein the weighting factor is a distance dependent value depending on the distance between the maintenance unit and processing stations to be serviced.

18. The method as in claim 16, wherein the weighting factor is a success factor dependent upon a probability of success of the maintenance unit in putting the processing stations back into operation.

19. The method as in claim 16, wherein the weighting factor is production efficiency of the processing stations to be serviced.

20. The method as in claim 16, wherein the weighting factor is a time value dependent upon the time during which the processing station has been out of operation.

21. A method for the maintenance of a plurality of processing stations of a textile machine wherein a maintenance unit travels alongside the processing stations for performing maintenance functions at individual respective processing stations, said method comprising:

defining at least one weighting factor for all of the processing stations, the weighting factor relating to a condition at the processing stations indicative of the need for maintenance;

determining a direction of travel of the maintenance unit to the next processing station to be serviced by the maintenance unit as a function of at least one weighting factor assigned to all processing stations requiring service by the maintenance unit, the weighting factor relating to a condition at the processing stations affecting efficiency of servicing all of the processing stations requiring maintenance; and identifying any processing stations that cannot be serviced by the maintenance unit and removing the identified processing stations from determination of the direction of travel.

22. A method for the maintenance of a plurality of processing stations of a textile machine wherein a maintenance unit travels alongside the processing stations for performing maintenance functions at individual respective processing stations, said method comprising:

defining preventative maintenance tasks to be performed at processing stations that are producing and not requiring actual maintenance, the preventative maintenance being a preferred maintenance that is expected to be necessary within a defined period of time;

performing the preferred maintenance at processing stations when none or a defined minimal number of conditions exist at other processing stations requiring service by the maintenance unit; and determining which processing station the preferred maintenance is to be performed at as a function of remaining production time at the processing stations without requiring a prior stop of such processing stations.

23. The method as in claim 22, comprising performing the preferred maintenance on processing stations in a defined final phase of production.

24. The method as in claim 22, comprising performing the preferred maintenance on processing stations when the source material being processes at the processing stations is depleted to a predetermined minimum quantity.

25. The method as in claim 22, comprising performing the preferred maintenance on processing stations when a predetermined minimum quantity of product produced at the processing stations has been exceeded.

26. A method for the maintenance of a plurality of processing stations of a textile machine wherein a maintenance unit travels alongside the processing stations for performing maintenance functions at individual respective processing stations, said method comprising:

defining preventative maintenance tasks to be performed at processing stations that are producing and not requiring actual maintenance, the preventative maintenance being a preferred maintenance that is expected to be necessary within a defined period of time;

performing the preferred maintenance at processing stations when none or a defined minimal number of conditions exist at other processing stations requiring service by the maintenance unit;

determining which processing station the preferred maintenance is to be performed at as a function of remaining production time at the processing stations; and wherein for a plurality of processing stations on which the preferred maintenance is to be performed, determining the direction of travel to a next processing station as a function of the total number of processing stations on which the preferred maintenance is to be performed.

27. The method as in claim 26, further comprising defining at least one weighting factor for all of the processing stations on which the preferred maintenance is to be performed, the weighting factor relating to a condition at the processing stations, considering the number of processing stations on which the preferred maintenance is to be performed in each possible direction of travel of the maintenance unit, and determining the direction of travel of the maintenance unit as a function of a value of the totality of the weighting factors for the processing stations in each possible direction of travel, the possible direction of travel having the greater value of weighting factors being selected as the determined direction of travel.

28. The method as in claim 27, wherein processing stations for which the preferred maintenance cannot be performed are not considered in determining the direction of travel.

29. A method for the maintenance of a plurality of processing stations of a textile machine wherein a maintenance unit travels alongside the processing stations for performing maintenance functions at individual respective processing stations, said method comprising:

prioritizing maintenance required at the processing stations into a high priority and at least one lower priority;

servicing the high priority processing stations with the maintenance unit;

for the lower priority processing stations, performing the following:

defining at least one weighting factor used for each of the processing stations, the weighting factor relating to a condition at the processing stations indicative of the need for maintenance; and determining a direction of travel of the maintenance unit to the next processing station to be serviced by the maintenance unit as a function of at least one weighting factor assigned to the processing stations requiring service by the maintenance unit, the weighting factor relating to a condition at the processing stations affecting efficiency of servicing all of the processing stations requiring maintenance.

30. A method for the maintenance of a plurality of processing stations of a textile machine wherein a maintenance unit travels alongside the processing stations for performing maintenance functions at individual respective processing stations, said method comprising:

prioritizing maintenance required at the processing stations into a high priority and at least one lower priority;

servicing the high priority processing stations with the maintenance unit;

for the lower priority processing stations, performing the following:

defining at least one weighting factor for all of the processing stations, the weighting factor relating to a condition at the processing stations indicative of the need for maintenance;

determining a direction of travel of the maintenance unit to the next processing station to be serviced by the maintenance unit as a function of at least one weighting factor assigned to all processing stations requiring service by the maintenance unit, the weighting factor relating to a condition at the processing stations affecting efficiency of servicing all of the processing stations requiring maintenance; and performing a lower priority maintenance at a processing station along a path of travel of the maintenance unit to a high priority processing station.

31. A method for the maintenance of a plurality of processing stations of a textile machine wherein a maintenance unit travels alongside the processing stations for performing maintenance functions at individual respective processing stations, said method comprising:

prioritizing maintenance required at the processing stations into a high priority and at least one lower priority;

servicing the high priority processing stations with the maintenance unit;

for the lower priority processing stations, performing the following:

defining at least one weighting factor for all of the processing stations, the weighting factor relating to a condition at the processing stations indicative of the need for subsequent maintenance; and determining an optimized readiness position for the maintenance unit alongside the textile machine when none of the processing stations requires the maintenance unit, the readiness position determined as a function of a statistical average of the weighting factor wherein, based on the statistical average, travel time and distance of the maintenance unit from the optimized readiness position to spinning stations requiring subsequent maintenance is reduced.

* * * * *